US005143245A

United States Patent [19]

Malone

[11] Patent Number: 5,143,245

[45] Date of Patent: Sep. 1, 1992

[54] LEAK-PROOF INSULATING SYSTEM FOR FREIGHT CONTAINERS

[75] Inventor: Thomas G. Malone, La Jolla, Calif.

[73] Assignee: Cargo Technology Corporation, San Diego, Calif.

[21] Appl. No.: 691,514

[22] Filed: Apr. 25, 1991

Related U.S. Application Data

[63] Continuation-in-part of Ser. No. 494,684, Mar. 16, 1990.

[51] Int. Cl.[5] ..... E04B 1/74

[52] U.S. Cl. ..... 220/445; 220/1.5; 220/452; 220/453; 220/470; 206/523

[58] Field of Search ..... 220/1.5, 3.1, 400, 445, 220/449, 451, 452, 453, 437, 470, 901, 408, 469; 206/523; 217/3 R, 34 C; 428/71; 150/154, 901

[56] References Cited

U.S. PATENT DOCUMENTS

| | | | |
|---|---|---|---|
| 2,066,337 | 1/1937 | Cunningham | 217/12 |
| 2,591,168 | 4/1952 | Latham, Jr. et al. | 220/3.1 X |
| 3,339,778 | 9/1967 | Herrenschmidt | 220/452 X |
| 4,021,982 | 5/1977 | Kotcharian | 220/453 X |
| 4,339,039 | 7/1982 | Mykleby | 220/445 X |
| 4,373,643 | 2/1983 | Przytarski | 220/450 |
| 4,497,859 | 2/1985 | Baumann | 220/448 X |
| 4,709,817 | 12/1987 | Keady et al. | 206/523 |
| 4,730,748 | 3/1988 | Bane | 220/452 X |

*Primary Examiner*—Steven M. Pollard

*Attorney, Agent, or Firm*—Knobbe, Martens, Olson & Bear

[57] ABSTRACT

A freight insulating system for either temporarily retrofitting a conventional uninsulated freight container or insulating cargo transported on individual pallets is provided. When retrofitting a container, a plurality of individual insulation support members are selectively attached to the interior walls of the freight container and a multi-layer insulated bag is attached to and is suspended from the support members, covering and surrounding the freight cargo. When fashioned out of a cross-linked polyethylene foam, the support members provide heat insulation capability as well as spacing the insulating bag a distance from the interior container surface, creating an insulating layer of air while simultaneously providing the requisite minimum air space for the reflective foil layer (described below) to perform at its maximum thermal efficiency. Additional insulating enhancement is provided by constructing the bag out of individual insulating blankets, each of which being fabricated out of two layers of a closed-cell polyethylene material laminated together, with a layer of reflective foil attached to the blanket surface that faces the container wall. These individual blankets are then heat-sealed together along the lateral edges thereof, thus forming the insulated bag. The insulation envelope is completed by an insulated floor covering sheet, which may also consist of a closed-cell polyethylene insulating material.

15 Claims, 2 Drawing Sheets

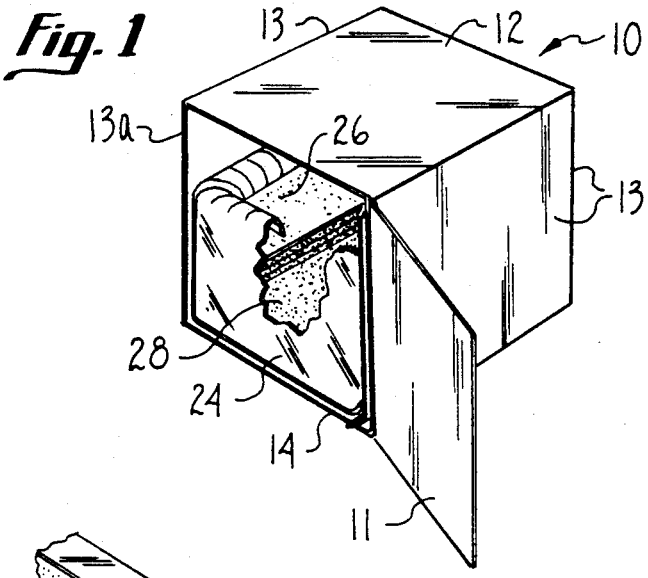
Fig. 1
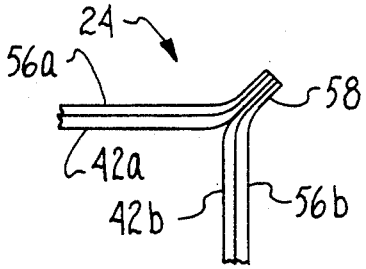
Fig. 3A
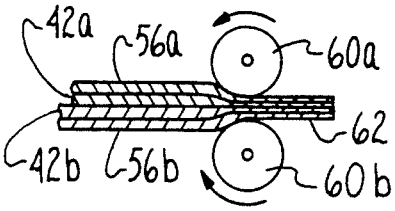
Fig. 3B
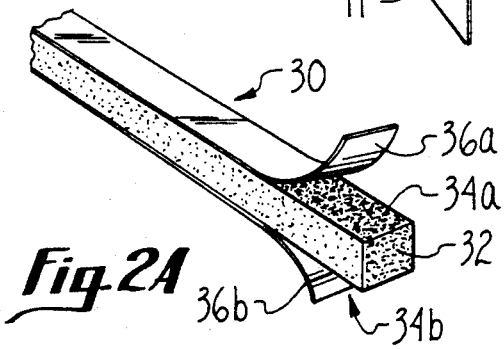
Fig. 2A
Fig. 2B
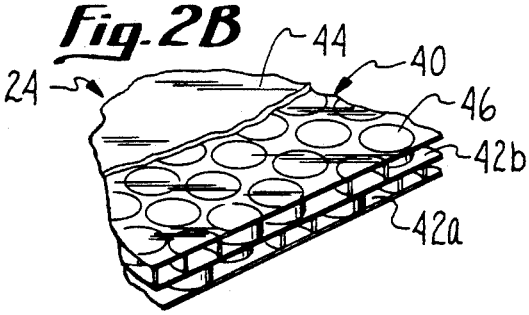
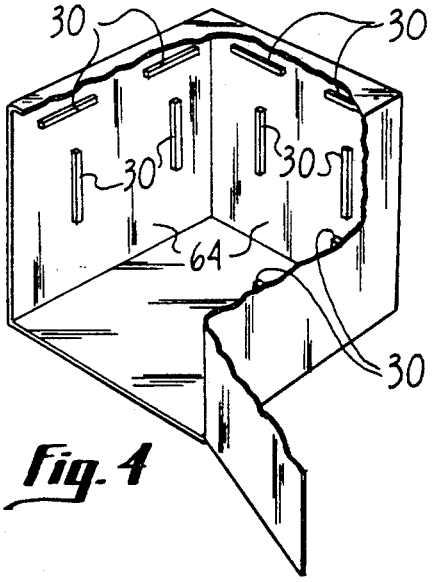
Fig. 4
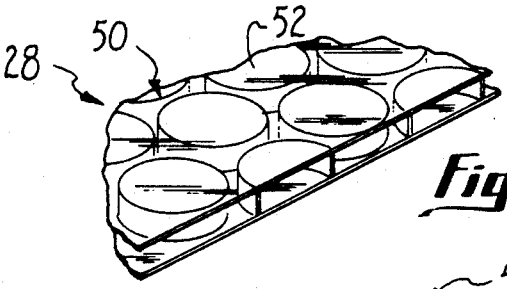
Fig. 2C
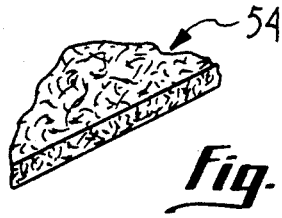
Fig. 2D

LEAK-PROOF INSULATING SYSTEM FOR FREIGHT CONTAINERS

RELATED APPLICATIONS

The present application is a continuation-in-part of co-pending application, U.S. Ser. No. 494,684, filed Mar. 16, 1990 entitled Freight Container Insulating System and Method.

FIELD OF THE INVENTION

The present invention relates to insulation systems for freight containers and more particularly to a pre-fabricated, leak-proof insulation system that permits the rapid conversion of conventional freight containers to a cargo container suitable for transporting cargo that requires controlled environments and which is susceptible to leaks.

BACKGROUND OF THE INVENTION

When transporting perishable goods, a conventional air cargo container has inadequate insulation to maintain a controlled temperature environment, such that unacceptably high loss levels of perishable goods are encountered during transport. As such, insulation systems are necessary in order to provide a satisfactory environment for the cargo. However, as discussed in the co-pending application referenced above ("the '684 application"), the specification of which is fully incorporated herein by reference, presently-available refrigerated freight containers which employ a self-contained refrigeration unit are inadequate.

There are advantages of providing an insulation system that can be used to convert a conventional container without the need for more expensive retro-fitting. For many transport businesses, efficient operation depends on the flexibility of handling various types of freight on a daily basis, including both freight that is environmentally sensitive and shipments that are not. Having the capability to convert a conventional container into an insulated container is advantageous to many transport businesses. Presently available means for such conversion are limited in their use as well as being expensive and inconvenient to install. The '684 application discusses the inability of other prior art systems to accomplish ready convertability of a cargo container with a pre-fabricated insulation system that employs a support system that is itself insulative. Such a system is disclosed in U.S. Pat. No. 4,497,859 to Baumann, which discloses an insulating insert consisting of panels of alternating, closely-packed insulating material that are joined along their perimeters to conform to the interior of the transport container. A fluid-tight trough and bottom plate are also provided in the Baumann system, making it cumbersome to install.

The invention described in the '684 application is a freight container insulation system capable of retrofitting a conventional uninsulated freight container, which system includes an adhesive support means for attaching the insulation system to the interior walls of the container, a multi-layer insulated blanket affixed to the adhesive support means, covering the interior container walls to which the adhesive support means is attached, a second multi-layer insulated blanket that is draped across an access opening to the container, and an insulated sheet for placing across the bottom of the container, whereby a controlled environment is created within the confines of the container. The preferred embodiment of that invention includes a plurality of linear insulative strips as the adhesive support means that may be selectively sized and then affixed to the interior walls of the container in a random orthogonal fashion, and wherein the insulated blanket comprises at least one layer of a closed-cell polyethylene and at least one layer of a reflective foil laminate, which may be formed into a roll or be prefabricated and sectioned into discrete individual panels that are sized to cover a corresponding interior container wall, with the insulated sheet for the container bottom constructed of closed-cell polyethylene.

One of the more important features of the invention described in the '684 application is a layer of air provided between the container walls and the installed insulation blanket, thereby incorporating the insulative qualities of air and the reflective qualities of a bright foil laminate as part of the insulation system. Such a system has the advantages of providing a cost-efficient and simplified insulation system that is effective at maintaining a controlled environment.

However, despite the effectiveness of this invention, there remains a need to utilize such a system in the context of cargo which is susceptible to leaks. As may be expected, some perishable goods are liquid based or are made with substances that retain fluid consistencies, which may penetrate the surrounding packing and leak into the interior of the cargo container and ultimately the aircraft. In such events, an insulation system employing individual discretely-constructed panels may not prevent the inadvertent escape of such fluids outside the container.

Depending on the nature of the fluids, a certain amount of damage may result to the interior components of the aircraft. For example, air freight containers are commonly used by the fishing industry for rapid transportation of fish throughout the world. The unfortunate result of shipping large quantities of fish is the undesired accumulation of fish oil in the shipping container. Fish oil is a very corrosive liquid and its inadvertent escape into the cargo area of the aircraft requires the immediate initiation of an expensive cleaning and removal process. Corrosion in the environment of a pressurized airframe can lead to catastrophic structural failure.

In light of the corrosiveness of some liquids, there is a need for a convertible insulation system that is effective at maintaining a controlled environment over relatively long periods and that is leak proof so as to prevent the undesired leaking of liquid cargo into the container and the aircraft.

SUMMARY OF THE INVENTION

The instant invention may be used to convert a conventional freight transport container into an insulated container, which is then capable of maintaining a leak-proof controlled temperature environment for perishable goods and other specially-handled cargo. By permitting transport businesses to convert a wide variety of containers into insulated containers, the present invention permits a freight transporting business to maintain flexibility while offering the added advantage of reducing it's investment in inventory and fixed costs. Additionally, the freight container insulation system of the present invention provides a means of converting a conventional freight container into an insulated container in a matter of minutes, thus saving assembly time and labor costs over current methods of conversion. The present system has the added advantage of providing a leak-proof environment that facilitates the shipment of cargo having liquid contents and also prevents the undesired damaging effects of leaking cargo. An additional advantage of the present invention is that it is suitable for transporting corrosive cargo that may be transported without a cargo container, i.e., on conventional pallets.

The present invention comprises three lightweight components designed to provide cumulative insulating effects. The first component of the preferred embodiment is an insulation support system, which in the preferred embodiment comprises a polyethylene foam element, in the form of a strip or pad. The foam element is used to attach the second component of the present insulation system to the inner container walls. The attachment is configured in a manner that separates the second component from the inner surface of the container walls, creating an insulating dead air space. This second component, discussed below, hangs from the foam elements (e.g., strips or pads) and is attached thereto by adhesive means provided directly on the support means, i.e., the foam elements. Under normal circumstances, the foam elements are laminated on both sides with a strong paper-backed adhesive to permit the user to quickly affix the strip to the container walls simply by peeling the paper away from the polyethylene foam core and pressing the same against an inner container wall. The foam elements may easily by cut to desired lengths, and then may be arranged in a random orthogonal fashion along the interior of the container, or if desired, in a more uniform grid fashion. It is intended that the strips be affixed to create a "baffled" surface over the container wall, which, in conjunction with the second component, creates the insulating air spaces.

The second component of the preferred embodiment is a multi-ply laminated sheet of polyethylene insulation constructed preferably in the form of an "insulation bag." The insulation bag comprises a plurality of adjacent panels bonded together to form a five-sided resilient insulation package having an opening in the top. The panels forming the insulation "bag" are preferably constructed of at least two layers, including a closed-cell polyethylene layer and an exterior layer of reflective foil laminate. Attaching directly to the adhesive sticks, the insulation bag is insertable in the container with the foil side directed outwardly from the interior of the container and functioning as a heat reflector.

The side panels of the insulation bag are supported by the adhesive-coated foam elements affixed to the container walls. When the insulation bag is loaded to allowable cargo container weight limits, including the refrigerant where required, the top portions of the side panels comprising the insulation bag are folded over upon each other so as to effectively overlap and seal in the contents. With the cargo effectively insulated, the container door may be closed and secured, and the container transported to its final destination. By employing an insulation bag comprising bonded components, any cargo that contains liquids susceptible to leaking may be thermal-effectively shipped while preventing potentially harmful leaks into the aircraft. In addition, by bonding the insulative panels together, any separation of the otherwise discrete panels due to the possible rough handling while loading, or due to impact loads caused by the shifting of the cargo within the container during transit is eliminated, ensuring a complete insulative envelope for the cargo.

A third component of the preferred embodiment is a separate, single sheet of closed-cell polyethylene that is used to cover the bottom of the insulation bag prior to loading. The polyethylene sheet provides effective insulative capabilities even while compressed under the weight of the cargo stored within the insulation bag. It is intended that the polyethylene sheet extend up and overlap a portion of each side panel of the insulated two-layer bag that extends down along the interior sides of the cargo container and across the bottom, forming an effective interior "insulation envelope" for the cargo.

It is contemplated that the insulation bag may be used in an alternative fashion. For instance, there are occasions where cargo may be transported without the need for a rigid cargo container. Some cargo is suitable for transport on conventional pallets. The insulation bag of the present invention is suitable for insulating such cargo in a leak-proof manner and may be utilized by simply placing the bag in an upright position directly on the pallet. In addition, the polyethylene sheet may be placed on the bottom of the bag to maintain effective insulation while sustaining the weight of the cargo. As with the above-described use, the insulation bag may be filled with cargo and the top portions of the insulation bag folded over in a preferably overlapping fashion so as to envelop the cargo therewithin.

It is well known that air has exceptional insulative qualities, and that the creation of "dead airspace" is desirable to enhance an insulation system. In the present invention, the resulting air layer that is created along the interior container walls by using the foam elements to attach the insulated envelope or blanket to the interior walls, provides a thermally efficient layer of insulation that, together with the insulation envelope, significantly reduces convective heat transfer. It is important to note as well that the material chosen for the foam elements is designed to provide some insulative qualities, preventing the insulation support structure from itself serving as a source of conductive heat transfer from the ambient surroundings. Further amounts of conductive heat transfer are reduced by the double layers of closed-cell polyethylene in the insulated blanket. The foil laminate covering the exterior face of the insulated blanket acts to reflect radiant heat directed toward the container during transport, redirecting this radiant heat back towards the outside container. Consequently the system as a whole is effective in significantly reducing all three types of heat transfer-convective, conductive, and radiant.

It is further well known that a radiant barrier in open space can reflect up to 96% of the radiant heat energy striking the barrier. In the instant invention, one embodiment envisions the use of this radiant barrier bag as providing both insulative qualities and leak-proof qualities to the transport of environmentally sensitive cargo.

The advantages of the present invention are that the freight container insulation system is light-weight, so that shipping costs reflect the weight of the cargo and not the weight of the insulation. In addition, the components of the system are strong enough to be reusable, while maintaining the insulative characteristics necessary to provide a leak-proof controlled environment over relatively long periods of time in transit. When a freight container has reached its intended destination and the cargo is unloaded, the insulation system may be rapidly removed from the cargo container and reserved for later use. The insulation bag is simply peeled away from the adhesive-coated foam elements, which may themselves be peeled away from the container walls. The entire leak-proof system may then be stored until it is desired to insulate another cargo container at a later date.

Other advantages should be appreciated for the present invention. Although durable, the leak-proof insulation system utilizes readily available components, which are sufficiently inexpensive to permit a user to either retain or dispose of the used leak-proof system, and still remain cost-effective. The leak-proof insulation system may also be made available in the form of readily-installed kits, designed for installation in standard-sized freight containers. Finally, because the system is capable of converting virtually all available cargo containers presently being used in the air transport industry, the use of the leak-proof insulation system may improve the flexibility of the cargo container inventory owned or leased by a transport business in a cost-effective manner.

BRIEF DESCRIPTION OF THE DRAWINGS

These and other advantages of the present invention may best be understood through reference to the drawings, in which:

FIG. 1 is a right-front perspective view of the preferred embodiment showing the insulation bag as it is installed within a converted cargo container; a portion of the bag being cut away to expose a portion of the bottom insulation sheet;

FIG. 2A is an enlarged partial perspective view of the laminated polyethylene foam strip;

FIG. 2B is an enlarged partial perspective view with portions broken away of the dual-layer closed-cell polyethylene insulated blanket having an outer layer laminated with foil;

FIG. 2C is an enlarged partial perspective view of one embodiment of the bottom insulation sheet;

FIG. 2D is an enlarged partial perspective view of a second embodiment of the bottom insulation sheet;

FIG. 3A is a partial enlarged sectional view of the point of attachment of two adjacent panels of the insulation bag;

FIG. 3B is the preferred embodiment of a rotary heat sealing device use for bonding individual panels of the insulation bag together in a heat sealing manner;

FIG. 4 is a perspective view, with portions broken away, showing the laminated strips as affixed to the interior vertical walls of a cargo container during installation of the insulating system of the present invention;

DETAILED DESCRIPTION OF THE PREFERRED EMBODIMENT

Figure 5:
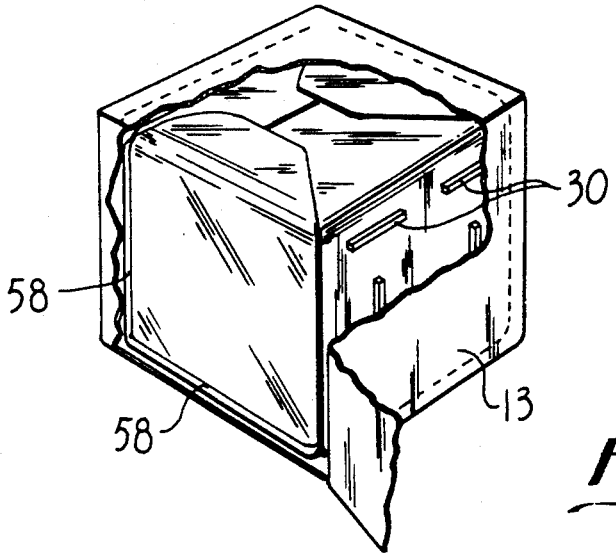
FIG. 5 is a perspective view similar to FIG. 3, with portions in phantom and portions broken away, showing the insulated bag affixed to the laminated strips, with the top portions of the side panels shown overlapping each other at the top.

Reference is now made to the figures wherein like parts are designated with like numerals throughout.

The invention is a leak-proof insulation system for use in cargo containers such as those used in the transport of freight by airlines. Cargo containers are generally available in numerous shapes and sizes to accommodate various volumes and types of freight and their installation in the cargo areas of airplanes. The cargo insulation system of the present invention is capable of effectively insulating a cargo container having virtually any shape and/or dimensions. As an example, FIG. 1 shows a typical cargo container 10 of generally cubic shape with a door 11, a top wall 12, three side walls 13 and a bottom wall 14. When properly installed, the present invention acts as a leak-proof insulating envelope, forming a heat "barrier" between the interior walls of the cargo container and the freight and preventing the leakage of fluids contained within the insulation system into the container itself or into the cargo area of the aircraft.

Still referring to FIG. 1, the insulation system 20 is shown installed within the interior of the cargo container 10 with a portion of the insulation system cut away to expose the interior of the insulation system. The preferred embodiment of the insulation system 20 comprises a leak-proof insulation "bag" 24 formed by bonding a plurality of insulating wall panels together. The individual panels are sized to conform to the size of the corresponding container wall 13 on which it is positioned. For example, side panel 26 is shown covering side wall 13*a* in FIG. 1. Panel 26 is preferably identical in construction, although not necessarily in shape and size, to the adjacent insulating panels sized to cover the two remaining side walls 13, as well as the bottom container wall 14.

In addition to the insulation bag 24, the invention comprises a floor sheet 28 covering the bottom panel of the insulation bag 24. The floor sheet 28 is intended to effectively insulate the contents of the container from the bottom while sustaining the weight of the cargo in the container 10. The floor panel 28 is discussed in further detail in reference to FIG. 2D.

During loading and unloading, the door 11 of the container 10 is opened as shown in FIG. 1 to facilitate access to the interior of the container 10. The insulation bag 24 is positioned in the container 10 so that the opening in the insulation bag 24 is directed upwardly. The top portion of the side panels, e.g., side panel 26, are folded inwardly as cargo (not shown) is placed within the bag 24. As the cargo is piled higher, the top portion of the side panels are raised to accommodate the cargo. When sufficient cargo has been loaded to reach the maximum allowable weight, the top portions of the side panels are folded over on themselves, as shown in FIG. 4, thus enveloping the cargo within the insulation bag 24. Because the panels of the insulation bag 24 are bonded together, the container 10 as well as the cargo-containing area of an aircraft in which the container 10 is stored is protected against inadvertent leaks from the cargo. With the insulation bag 24 closed, the door 11 of the container 10 may be closed and the container with its now-protected load of perishable or other environmentally sensitive goods is ready to be shipped.

The insulating system 20 comprises three basic components as may be seen by referring to FIGS. 2A–2D. The first component is an insulation support system which itself exhibits insulative characteristics. In the preferred embodiment, the insulation support system comprises a number of polyethylene foam strips or elements 30, one of which is shown in FIG. 2A. Although not shown in the figures, the foam material can also be provided in the form of a pad, shaped as desired—whether circular, rectangular, or irregular. Sometimes referred to as a "stick" (when in strip form), the foam strips 30 (or pad) consist of a cross-linked polyethylene foam core 32, such as Polyolefin, which is readily available and may be obtained from Arlon of Santa Ana, Calif. The foam strip 30 is coated on a pair of opposite surfaces 34*a* and 34*b* with a releasible-adhesive material. In the preferred embodiment, the adhesive material is an acrylic-based Dow Chemical adhesive. However, it is contemplated that the adhesive material may be any adhesive that permits effective adhesion between the foam strip 30 and the interior surface of the container (shown in FIG. 1). A first adhesive-coated surface 34*a* may be exposed by pulling away a protective layer of paper 36*a* from the adhesive and attaching the first adhesive-coated surface 34*a* to the cargo container (shown in FIG. 1) in a manner described more fully below.

A second component of the present invention is the leak-proof insulative bag 24, which comprises in the preferred embodiment a continuous sheet-form insulative layer, shown in FIG. 2B as a three-ply insulative sheet 40. FIG. 2B shows a portion of the insulative sheet 40 illustrating in detail a pair of layers of polyethylene material 42*a* and 42*b* joined together and laminated on one side by a layer of reflective foil 44, (or, instead, a metalized plastic film layer). The polyethylene layers 42*a*, 42*b* may be made of hot formed polyethylene or other similar material, such as is supplied by Sealed Air Corporation, Los Angeles, Calif., or by other manufacturers in the packaging materials industry. The polyethylene layers 42*a*, 42*b* are constructed with a plurality of closed cells 46, which act to increase the insulative capabilities of the insulative sheet 40 by trapping dead air within. It should be noted that while it was contemplated in the '684 application that the insulative sheet 40 may consist of a continuous sheet, either planar or as an open bag sized to fit the interior walls of a cargo container, in the preferred embodiment of the present invention, the insulative sheet 40 is sectioned into individual panels that correspond in dimensions to the interior walls of the cargo container 10 and bonded together at the perimeter as shown in FIG. 3. Regardless of the form of the insulative sheet 40, the insulation bag 24 is affixed to the second, adhesive-coated surface 34*b* of the foam elements 30 (See FIG. 2A).

Another component of the present invention insulation system 20 (FIG. 1) is the insulative floor covering sheet 28; a portion of a first embodiment 50 of the insulative floor covering sheet 28 being shown in FIG. 2C. As indicated above, the floor covering sheet 28 is draped across the bottom panel of the insulation bag 24 (FIG. 1). Similar in design to the layers 42*a*, 42*b* of the insulative sheet 40, the first embodiment 28 of the floor covering sheet 50 is likewise preferably made of hot-formed polyethylene.

However, instead of comprising two layers 42*a* and 42*b* having a thickness of 5/16 inches, the first embodiment 28 of the floor covering sheet 50 is preferably a single layer of ½ inches in thickness, and no foil layer is required. Additionally, instead of bubble diameters of 5/16 inches, the first embodiment 28 of the floor covering sheet 50 utilizes a plurality of enlarged cells 52, having bubble diameters of 1 inch, with plastic layer thickness of 13 mils—or whatever is necessary to support the cargo. The two layer laminate uses plastic of 8 mils. These design modifications permit the first embodiment 28 of the floor covering sheet 50 to withstand the weight of the cargo as well as the loading process itself, while remaining an effective insulator. The first embodiment 28 of floor covering sheet 50 having such fortified features may be obtained from the same supplier as the two-layer, insulative sheet 40.

Alternatively, the floor panel 28 may be constructed of a sheet of closed-cell polyethylene foam 54, a portion of which is shown in FIG. 2*d*. The polyethylene foam sheet 54 is constructed of hot formed polyethylene such as is provided by Seal Air Corporation.

As indicated above, one of the important features of the present invention is its leak-proof nature. This feature is provided by bonding individual panels of the insulative sheet 40 together to form the leak-proof insulation bag 24. In the preferred embodiment, the individual panels are joined to form a box-like arrangement, with the panels substantially perpendicular to one-another, as shown in FIG. 3. Attachment of the panels is by heat sealing, which is preferred over conventional gluing/adhesive materials operations because a heat sealed joint is less susceptible to failure when exposed to corrosive liquids. However, for the shipment of non-corrosive cargo, an insulation bag can be used that is formed by gluing individual insulation panels together with an appropriate adhesive.

In FIG. 3A, two panels 56*a* and 56*b* of the insulation bag 24 are shown bonded together along adjacent edges thereof to form a leak-proof corner 58. While it is acknowledged that it is difficult at best to heat seal the two aluminum foil layers together, the panels 56*a* and 56*b* may be heat sealed by placing the interior layers 42*a* of the panels 56*a*, 56*b* adjacent to one another. As indicated above, the interior layers 42*a* and 42*b* are constructed of polyethylene, which is a type of plastic. Such material readily melts at temperatures of 350° F. or above. As such, placing the interior layers 42*a* and 42*b* of the panels 56*a*, 56*b* together permits the panels 56*a*, 56*b* to be bonded together by melting the plastic layers together. If it desired to bond the panels 56*a*, 56*b* together by other than heat sealing methods, the type of adhesive material selected must provide a flexible, waterproof, and absolutely uniform seam connection. In either case, the leak-proof corner 58 is formed so as to prevent the passage of liquids therethrough.

Referring now to FIG. 3B, the method for bonding the insulation panels together to form the insulation bag 24 can be explained. In the preferred embodiment, a heat sealing method is contemplated which involves a rotary heat sealing device, as shown. As indicated above, the heat sealing method of the present invention depends upon joining the interior layers 42*a*, 42*b* of the panels 56*a*, 56*b* together. In the preferred method, the panels 56*a*, 56*b* are superposed so that their respective interior layers 42*a*, 42*b* abut one-another. Two rollers 60*a* and 60*b* are positioned on a structural support (not shown) so as to tightly permit the passage of the panels 56*a*, 56*b* therebetween. The rollers 60*a*, 60*b* rotate counter-currently as shown by the arrows and simultaneously apply heat to the panels 56*a*, 56*b* so as to provide a heated press fit. The end result is a heat-sealed seam 62 that forms the leak-proof corner discussed above in association with FIG. 3A. The precise amount of pressure applied by the rollers to the panel material requires somewhat of a trial-and-error approach. There must be sufficient pressure so that the trapped air in the insulative bubbles is allowed to escape as the plastic material softens, but not so much pressure that the bubbles destructively rupture, leaving a hole in the insulation material. While applying pressure, the rollers must remain heated to the 350° F. melting range for the plastic insulation material.

Referring now to FIGS. 4 and 5, the manner by which the insulation support system, the insulative bag 24 and the insulative floor covering sheet 28 are combined to form the present innovative insulation system may be more clearly described. When it is desired to install the insulation system, a plurality of foam elements 30 may be affixed to the cargo container 10, as shown in FIG. 4. A first adhesive-coated surface 34*a* (FIG. 2A) of the foam strip 30 attaches directly to an interior surface of the container 10, while a second adhesive-coated surface 34*b* is available to attach to and support the insulative bag 24, as is described above. While the foam elements 30 may be arranged in any desired pattern on the interior walls of the container 10, FIG. 4 shows the strips arranged in a spaced orthogonal pattern. It is also contemplated that the foam elements may be arranged in a more random format, or in a precise, uniform grid pattern, as desired. Once the foam elements 30 are positioned as desired and attached to the interior walls, the protective layer of paper 36*b* (FIG. 2A) may then be peeled away to expose the second adhesive-coated surface 34*b* to which the foil laminate 44 (FIG. 2B) on the bonded panels of the insulation bag 24 may be adhered.

FIG. 5 shows the insulation bag 24 installed in place within the container 10. There it can be seen that the first closed-cell, polyethylene layer 42*a* of the insulation sheet 40 is shown exposed toward the interior of the cargo container 10 while the foil laminate 44 is shown facing the opposite direction, toward the container walls. The resulting insulative air layer 64 is defined by the space formed between the insulation bag 24 and the container walls. With the insulating bag 24 in place, a continuous envelope of insulation is provided around the load of freight when the insulation system is completely installed.

Figure 6:
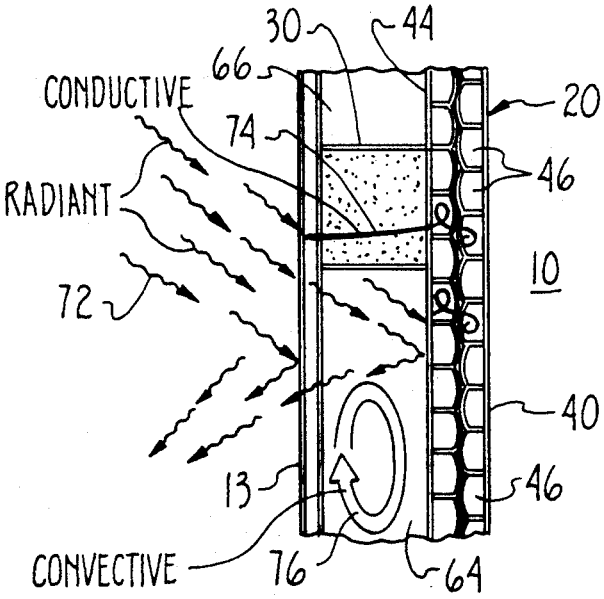
FIG. 6 is a representative cross-section of the present invention shown attached to a vertical container wall schematically illustrating the thermal properties of the present invention.

An appreciation of the thermal properties of the insulation system having the above-described arrangement can be obtained by referring to FIG. 6. There a representative, cross-sectional view of a portion of the insulated sheet 40 can be seen. The foam strip 30 is affixed to the container wall 13 in a horizontal position, thereby separating the insulative sheet 40 from the container wall 13, and creating the insulative air layer 64, described above. The insulative sheet 40 is shown with its two adjoining layers of closed-cell polyethylene 42*a* and 42*b* coated with the foil laminate 44.

Schematically, FIG. 6 illustrates how the insulation system 20 of the present invention significantly reduces the heat transfer from the ambient surrounding. First, radiant heat, depicted by arrows 72, is partially repelled by the container wall 13 itself. The radiant heat that penetrates the container wall is then further repelled by the foil laminate 44 which functions similar to a mirror in reflecting incoming rays. Conductive heat transfer, shown by arrow 74, is reduced initially by the insulative properties of the polyethylene foam elements 30. A majority of the balance of conductive heat that penetrates the foam element 30 is then trapped within the closed-cells 46 of the insulative sheet 40, further reducing the transfer into the interior of the container 10. Finally, the insulative air layer 64 acts to trap significant amounts of convective heat within, shown by arrow 76. In cooperation with each other, the components of the insulation system 20 significantly reduce the heat transferred to the interior of the cargo container from the ambient environment, thereby permitting a selected environment to be maintained within the container for a period of time during transport much longer than would otherwise be possible.

Figure 7:
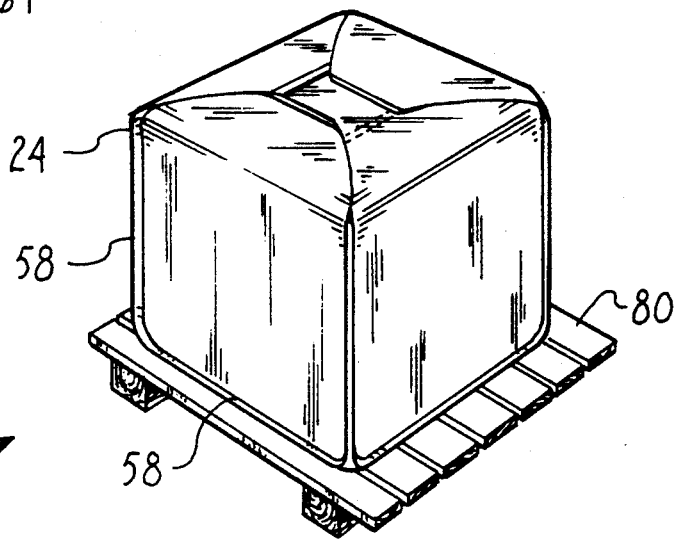
FIG. 7 is a perspective view similar to FIG. 3, showing the insulated bag being used in an alternative fashion, i.e., placed directly on a shipping pallet.

It is also contemplated that the insulation bag 24 may be used in an alternative fashion than as indicated above. The insulation bag 24 of the present invention is suitable for insulating corrosive and non-corrosive cargo in a leak-proof manner. Referring now to FIG. 7, it may be appreciated that the insulation bag 24 may be utilized by simply placing the bag 24 in an upright position directly on a shipping pallet 80. If desired, the insulative floor covering sheet 28 (not shown) may be placed on the bottom of the insulation bag 24 to maintain effective insulation while sustaining the weight of the cargo. As with the above-described use, the insulation bag 24 may be filled with cargo and the top portions of the insulation bag folded over in a preferably overlapping fashion, as shown, so as to envelop the cargo therewithin.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed is:

1. A leak-proof freight container insulation system capable of retrofitting a conventional uninsulated freight container, said insulation system comprising:

a plurality of insulative strips, each having opposing sides having an adhesive deposited thereon for attaching the insulation system to the freight container, the strips being readily removable from the freight container;

a multi-layer insulated bag affixed to the insulative strips so that the container walls covered with said insulative strips are correspondingly veiled with said insulated bag; and an insulated sheet placed across the bottom of the insulated bag.

2. The leak-proof insulation system of claim 1 wherein said insulation system defines a layer of air between the container walls and the insulation bag.

3. The leak-proof insulation system of claim 2 wherein the insulated bag comprises individual panels bonded together, said individual panels being sized and shaped to cover corresponding interior walls of the uninsulated container.

4. The leak-proof insulation system of claim 3 wherein the bonded panels are heat-sealed.

5. The leak-proof insulation system of claim 2, wherein the adhesive support means is a plurality of elements, said elements being constructed of insulative material.

6. The leak-proof insulation system of claim 2 wherein the panels of the insulated bag comprise at least one layer of closed-cell polyethylene and at least one layer of reflective foil laminate.

7. The leak-proof insulation system of claim 2 wherein the insulated sheet is constructed of closed-cell polyethylene foam.

8. A leak-proof insulation system for converting an uninsulated, conventional, freight container, said insulation system comprising:

a plurality of adhesive-backed and faced strips arranged in a spaced random pattern on at least four interior walls of the freight container, said strips exhibiting insulative qualities;

an insulated bag affixed to the strips and covering the bottom and vertical walls of the interior of the container said insulated bag establishing, in combination with the container, an air space between the bag and the container, said insulated bag laminated with reflective foil directed outwardly, and an insulated sheet placed on the bottom of the insulated bag.

9. The leak-proof insulation system of claim 8 wherein the insulated bag comprises individual panels bonded together, said individual panels sized and shaped to cover corresponding interior walls of the uninsulated container.

10. The insulation system of claim 9 wherein the panels of the insulated bag are constructed of two layers of closed-cell polyethylene.

11. The insulation system of claim 8 wherein the elements are constructed of polyethylene foam.

12. The insulation system of claim 8 wherein the insulated sheet is constructed of closed-cell polyethylene foam.

13. A method of converting an uninsulated freight cargo container into a leak-proof insulated container capable of providing a leak-proof controlled environment, said method comprising:

affixing readily removable insulative strips having adhesive deposited on outer and inner surfaces thereof onto the interior walls of the uninsulated container; and affixing a multi-layer composite insulated bag to the inner faces of said strips so that at least four interior walls of the container are covered with said insulated bag and so that a layer of air is defined between said insulated bag and the container walls.

14. The method of claim 13 further comprising the step of heat sealing individual panels of insulative material together to form the insulated bag.

15. A leak-proof freight container insulation system capable of retrofitting a conventional uninsulated freight container having a plurality of walls, said insulation system comprising:

a plurality of adhesive backed and faced insulative strips utilizing readily releasable paper backing for easily and rapidly attaching the insulation system to the freight container, said strips arranged in a spaced pattern on at least four interior walls of said freight container;

an insulated bag affixed to strips so that the container walls covered with said strips are correspondingly veiled with said insulated bag, said strips and said insulated bag affixed thereto defining a layer of air between the container walls and said insulated bag;

a second multi-layer insulated blanket draped across an access opening to the container, and an insulated sheet placed across the bottom of said insulated bag.

* * * * *